US011401056B2

(12) United States Patent
Dehaudt

(10) Patent No.: US 11,401,056 B2
(45) Date of Patent: Aug. 2, 2022

(54) PROCESS FOR MANUFACTURING CAPSULES AND ASSOCIATED SYSTEM

(71) Applicant: L'OREAL, Paris (FR)

(72) Inventor: Eric Dehaudt, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 17/272,968

(22) PCT Filed: Sep. 13, 2019

(86) PCT No.: PCT/EP2019/074460

§ 371 (c)(1),
(2) Date: Mar. 3, 2021

(87) PCT Pub. No.: WO2020/053374

PCT Pub. Date: Mar. 19, 2020

(65) Prior Publication Data

US 2021/0339895 A1 Nov. 4, 2021

(30) Foreign Application Priority Data

Sep. 14, 2018 (FR) ..... 18 58321

(51) Int. Cl.
*B65B 3/02* (2006.01)
*A45D 33/00* (2006.01)
(Continued)

(52) U.S. Cl.
CPC ..... *B65B 3/022* (2013.01); *A45D 33/00* (2013.01); *A45D 34/00* (2013.01); *A45D 40/00* (2013.01);
(Continued)

(58) Field of Classification Search
None
See application file for complete search history.

(56) References Cited

U.S. PATENT DOCUMENTS 2,299,039 A * 10/1942 Scherer ..... A61J 3/077 264/318
3,173,840 A * 3/1965 Hostetler ..... A61J 3/07 206/530
(Continued)

FOREIGN PATENT DOCUMENTS

FR 3 049 441 A1 10/2017
WO WO 2016/020454 A1 2/2016

*Primary Examiner* — Hemant Desai
*Assistant Examiner* — Tanzim Imam
(74) *Attorney, Agent, or Firm* — Polsinelli PC

(57) ABSTRACT

Process for manufacturing a plurality of capsules containing a cosmetic product, the process including the following steps: —displacement of a support (32) through a first reservoir (44) containing a viscous material (52) designed to form the side wall, and coating of the support with a layer (56) of the viscous material; —displacement of the support through a shaping module (28) and solidification of the layer of material; —withdrawal of the support outside the shaping module, freeing an internal slot (74) defined by the layer of solidified material; —entry of at least one cosmetic product (11) from a second reservoir (80) into the internal slot; and —cut out the layer using a cutting device (68) to form the side walls of at least one capsule, and sealing of the internal spaces of capsules containing the cosmetic product by seals.

20 Claims, 5 Drawing Sheets

(51) Int. Cl.

| | |
|---|---|
| ***A45D 34/00*** | (2006.01) |
| ***A45D 40/00*** | (2006.01) |
| ***B65B 1/02*** | (2006.01) |
| ***B65B 1/04*** | (2006.01) |
| ***B65B 3/04*** | (2006.01) |
| ***B65B 61/00*** | (2006.01) |

(52) U.S. Cl.
CPC ..... *B65B 1/02* (2013.01); *B65B 1/04* (2013.01); *B65B 3/04* (2013.01); *B65B 61/005* (2013.01)

(56) References Cited

U.S. PATENT DOCUMENTS

| | | | | | |
|---|---|---|---|---|---|
| 3,927,195 | A * | 12/1975 | Messora | A61J 3/077 | 220/8 |
| 4,247,006 | A * | 1/1981 | Bodenmann | A61J 3/077 | 426/138 |
| 4,894,978 | A * | 1/1990 | Schonmann | A61K 9/4833 | 53/238 |
| 5,082,661 | A | 1/1992 | Melnik et al. | | |
| 5,270,054 | A | 12/1993 | Bertolini | | |
| 6,015,513 | A * | 1/2000 | Sheffler | B29C 41/34 | 264/303 |
| 2017/0121039 | A1 * | 5/2017 | Ciesiun | B29C 64/182 | |

* cited by examiner

PROCESS FOR MANUFACTURING CAPSULES AND ASSOCIATED SYSTEM

CROSS REFERENCE TO RELATED APPLICATIONS

This application is a National Phase filing under 35 U.S.C. § 371 of PCT/EP2019/074460 filed on Sep. 13, 2019; which application in turn claims priority to Application No. 18 58321 filed in France on Sep. 14, 2018. The entire contents of each application are hereby incorporated by reference.

This invention relates to a process for manufacturing a plurality of capsules. The invention also relates to a system for preparing capsules designed to implement this process.

The process according to the invention aims to produce capsules containing one or several cosmetic products designed to be used in a device for preparation of a cosmetic composition.

Such a cosmetic composition particularly comprises a cosmetic body surface care, coloring or makeup product.

More generally, a cosmetic composition comprises one or a plurality of cosmetic products, as defined in EC Regulation No. 1223/2009 of the European Parliament and the Council of Nov. 30, 2009, relating to cosmetic products.

Preparation of a cosmetic composition from a plurality of capsules enables customization of the quantity or precise content of the cosmetic composition beyond predetermined options. Furthermore, it is well-suited to small-scale distribution, for example for retail outlets, that do not always use department layouts common in stores and superstores.

This preparation process requires the use of capsules containing a large variety of products so as to supply a large number of possible cosmetic compositions.

These capsules also have a variety of contents depending on the nature of the product, and therefore a variety of dimensions. In order to make them easily identifiable, it is desirable to give them a characteristic external appearance, for example with identifiable colors.

There is thus a need for a means of preparing capsules with satisfactory efficiency and good adaptability, while remaining easy to use for a retailer or a local distributor.

One purpose of the invention is thus to provide a process of producing cosmetic capsules such that a large number of capsules can be produced easily and quickly, and that can easily be adapted to a variety of contents of the capsules produced.

To achieve this, the purpose of the invention is a process of preparing a plurality of capsules, in which each capsule comprises a side wall and two seals defining an internal space containing a cosmetic product, the process including the following steps:

- displacement of a support through a first reservoir containing a viscous material designed to form the side wall, and coating of the support with a layer of viscous material;
- displacement of the support through a shaping module and solidification of the layer of material;
- withdrawal of the support outside the shaping module, freeing an internal slot defined by the layer of solidified material;
- entry of at least one cosmetic product from a second reservoir into the internal slot; and
- cutting of the layer using a cutting device to form the side walls of at least one capsule, and sealing of the internal spaces of capsules containing the cosmetic product by seals.

Such a process can be used to prepare capsules easily and sufficiently efficiently and can be adapted to a multitude of contents.

According to particular embodiments, the process according to the invention has one or several of the following characteristics, taken independently or in any technically feasible combination:

- the material is kept in the viscous state in the first reservoir by heating, and is solidified in the shaping module by cooling.

This variant enables forming of capsule walls without it being necessary to use a complex injection method or a method making use of an assembly line.

- in the step in which the support is withdrawn outside the shaping module, the cosmetic product fills the internal slot as the support is being removed; the cosmetic product continuously filling in a released space.

This variant guarantees that there are no air bubbles in the capsules.

- the support displacement step through the shaping module comprises the passage of the layer of viscous material through an extrusion die, forming an external surface of the layer.

This variant simply makes the outside diameter of all the capsules the same.

- the step to displace the support through the shaping module comprises drawing a film in contact with the outside surface of the layer, the film being capable of forming seals during the layer cutting step.

This variant can be used to make seals with a material different from the material of the walls, particularly a material for the seals not present in the cosmetic composition after the capsules have been used.

- the cutting step of the layer includes drawing of the material forming the layer through the internal slot to form seals, the seals being made from the same material as the side walls.

This variant makes fabrication of the seals easy, without requiring any additional material.

- the step to displace the support through the shaping module comprises creating contact between a distal end of the support and the layer of material with a practically hermetic outlet nozzle from the second reservoir, withdrawal of the support drawing the or each cosmetic product outside the second reservoir.

This variant prevents pollution of the cosmetic product contained in the capsules from the exterior.

- the process also comprises the following step:
- blocking of the layer of material in the shaping module and open an outlet nozzle from the second reservoir leading into the shaping module facing the support.

This variant makes filling and cutting the capsules reliable, and increases production rates.

- the inlet step of the or each cosmetic product in the internal slot comprises a step to pressurize the or each cosmetic product contained in a second reservoir, the pressurization facilitating ingress of the or each cosmetic product in the internal slot.

This variant facilitates filling of the capsules, particularly in the case of highly viscous cosmetic products.

The invention also relates to a capsule preparation system, each capsule comprising a side wall and two seals defining an internal space containing a cosmetic product,

- the system comprising:
- a fixed frame extending along a central axis;
- a support free to translate along the central axis relative to the frame;

a module to actuate the support in translation;

a first reservoir designed to contain a viscous material that will form the side wall of the capsules;

a shaping module of the capsules, comprising a cutting device;

a second reservoir capable of containing at least one cosmetic product, with an outlet nozzle, the support being free to move along a back and forth movement successively through the first reservoir and the shaping module to form a side wall with an internal slot, the outlet nozzle can be placed facing the internal slot to fill the internal slot with cosmetic product.

According to particular embodiments, the system according to the invention has one or several of the following characteristics, taken independently or in any technically feasible combination:

the support is an approximately cylindrical rod extending parallel to the central axis, the actuation module being capable of displacing the support in translation along the central axis and in rotation about the central axis.

With this variant, cylindrical capsules can be obtained simply and quickly.

the central axis extends approximately vertically relative to gravity.

This variant optimizes coating of the support and filling of the capsules.

the cutting device comprises a plurality of cutting elements arranged perpendicular to the central axis and at a uniform spacing in the shaping module along the central axis.

This variant gives a clean and regular cut of the capsules.

the actuation module, the first reservoir, the shaping module and the second reservoir are arranged in line along the central axis, the outlet nozzle of the second reservoir opening up in the shaping module.

This variant simplifies the layout of the capsule preparation system and reduces its dimensions.

Further features and advantages of the invention will emerge after reading the following description given solely as an example with reference to the appended drawings in which.

Figures 1, 2:
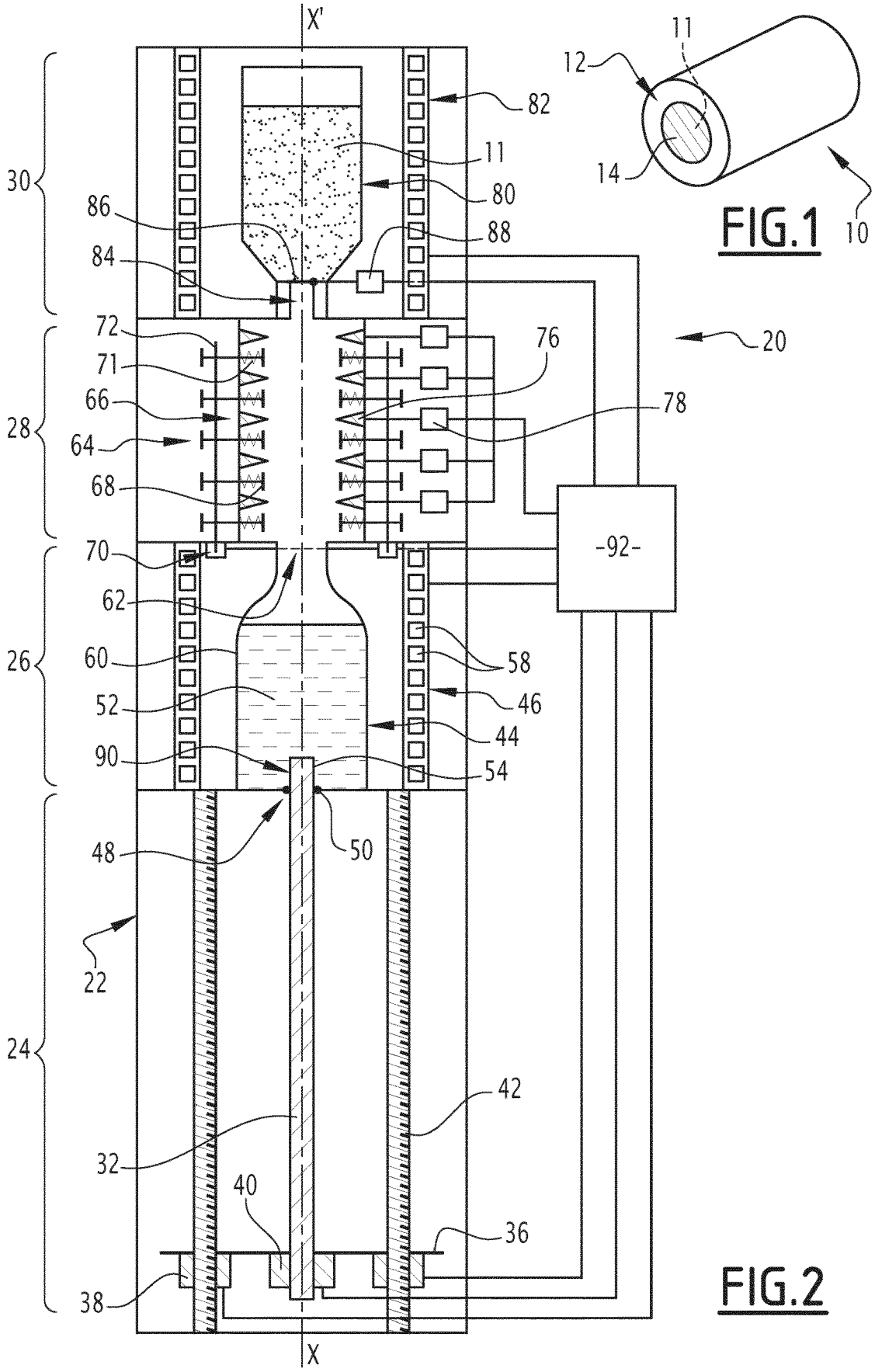
FIG. 1 is a perspective view of a cosmetic capsule.
FIGS. 2 to 6 are longitudinal sectional views of a system for preparation of capsules according to the invention during successive steps of a preparation process.

FIG. 1 represents a capsule 10 containing a cosmetic product 11. The cosmetic product 11 may for example be a component of a cosmetic composition.

The capsule 10 is intended particularly for use in a device for preparation of a cosmetic composition, at the same time as other capsules 10. The cosmetic products contained in each capsule 10 being capable of forming a cosmetic composition once mixed.

For example, the preparation can be made by piercing each side of the capsule, at its axial ends.

As a variant, the product contained in the capsule 10 alone forms the cosmetic composition.

The cosmetic composition comprises in particular a cosmetic body surface makeup, care and/or coloring product.

The cosmetic product 11 contained in the capsule 10 comprises for example one or several liquids with different viscosities, that are either aqueous or organic, one or several solids such as powders, particles and/or fibers, or a gel, an emulsion, a cream, a foam or others.

The capsule 10 comprises a substantially cylindrical side wall 12, defining a substantially cylindrical inner space and two seals 14 closing the internal space at two opposite ends.

The term "cylindrical" denotes that the side wall 12 and the internal space each have an external surface in the shape of a portion of cylinder, a cylinder being understood to be the geometric shape formed by a generatrix passing through a closed directrix curve inscribed in an orthogonal plane to the generatrix.

In the example shown on FIG. 1, the directrix curve is a circle, and the side wall 12 is thus in the shape of a cylinder portion with a circular cross-section.

Depending on the variant, the directrix curve is a square, a rectangle, an ellipse, a rhombus, or other shape.

The above definition is applied in the same way hereinafter to any cylindrical object.

The side wall 12 is in the form of a solid cylindrical sleeve having a substantially constant thickness on the periphery thereof, and a variable length from one capsule 10 to another.

The side wall 12 may for example be made of a plastic material, particularly a thermoplastic polymer, for example such as polyethylene (abbreviation PE) or polyethylene terephthalate (abbreviation PET).

As a variant, the side wall 12 is made from another material that can soften at high temperature, for example such as wax, sugar or glass.

The seals 14 are thin transverse walls, closing off the internal space of the capsule 10.

The seals 14 are for example of a single piece with the side wall 12.

As a variant, the seals 14 are made from a material different from the material of the side wall, and are fixed on a transverse surface of the side wall 12, for example by thermal bonding.

In particular, the seals 14 are made from a stretchable material sufficiently fragile to tear when the seals 14 are stretched beyond a rupture threshold, for example they may be made of rubber, particularly based on a acrylonitrile butadiene copolymer (called nitrile rubber), or based on latex.

Alternatively, the seals 14 are made of a fragile material, the presence whereof in the cosmetic composition causes no discomfort, such as for example from sugar, gelatin, wax or others.

The materials from which the side wall 12 and the seals 14 are made are advantageously recyclable, particularly by grinding and remelting.

A system 20 for preparation of a plurality of capsules 10 will now be described, with reference to FIGS. 2 to 6.

The system 20 comprises a fixed frame 22 extending along a principal elongation axis X-X', and an actuation module 24, a coating module 26, a shaping module 28 and a filling module 30 mounted on a frame 22 aligned in this order along the X-X' principal axis.

The system 20 also includes an approximately cylindrical rod 32, extending along the X-X' principal axis.

The X-X' axis advantageously extends vertically relative to gravity, the frame 22 and the actuation module being oriented downwards and the filling module 30 oriented upwards.

The rod 32 is installed such that it can move in a back and forth movement relative to the frame 22, through the actuation module 24, the coating module 26, the shaping module 28 and the filling module 30. In particular, the rod 32 is free to move in translation along the X-X' principal axis and in rotation about the X-X' principal axis.

The rod 32 forms a molding support for the side wall of the capsules 10. Thus, the rod 32 has a section in a plane orthogonal to the central axis X-X' approximately identical to a desired section of the internal space in the capsules 10.

As a variant, the production system 20 comprises a support that is not in the form of a rod and may have any required section of the internal space of the capsules 10, the section possibly varying along the extent of the support.

The actuation module 24 comprises a base 36 supporting one or several translation actuators 38 and a rotation actuator 40. The actuation module 24 also includes one or several threaded rods 42 installed fixed on the frame 22 and each engaged in one of the translation actuators 38.

In the example shown, the actuation module 24 comprises three translation actuators 38 and three threaded rods 42, only two of which can be seen on the figures that are sectional views.

As a variant (not shown), the actuation module 24 comprises a single translation actuator 38 in which one of the threaded rods 42 is engaged, and drive cams driven by the translation actuator 38 through a transmission belt, and in which the other threaded rods are engaged.

The rotation actuator 40 supports the rod 32, and is capable of applying its rotation movement about the X-X' central axis.

The translation actuators 38 support the base 36 and are capable of moving it in translation along the X-X' central axis, along the threaded rods 42. The movement of the base 36 applies its translation movement to the rod 32 along the X-X' central axis.

The translation actuator 38 and the rotation actuator 40 may for example be stepping motors.

As a variant, the translation actuator 38 and the rotation actuator 40 are another type of motor, for example electrical.

As a variant, the actuation module 24 does not operate through a direct mechanical drive, and for example comprises pneumatic or hydraulic means of actuating the rod 32, that is then in particular a hollow rod.

The coating module 26 comprises a first reservoir 44 and a first device 46 heating a content of the first reservoir 44.

The first reservoir 44 has a lower opening 48, that opens up in the actuation module 24 and contains the rod 32 free to slide in it.

The lower opening 48 has a section in a plane orthogonal to the X-X' principal axis practically the same as the section of the rod 32, such that the lower opening 48 is closed and is effectively sealed by the rod 32.

Advantageously, the lower opening 48 is provided with a peripheral seal 50 that improves leak tightness.

The first reservoir 44 contains a material 52 that will form the side wall 12 of the capsules 10.

Figure 3:
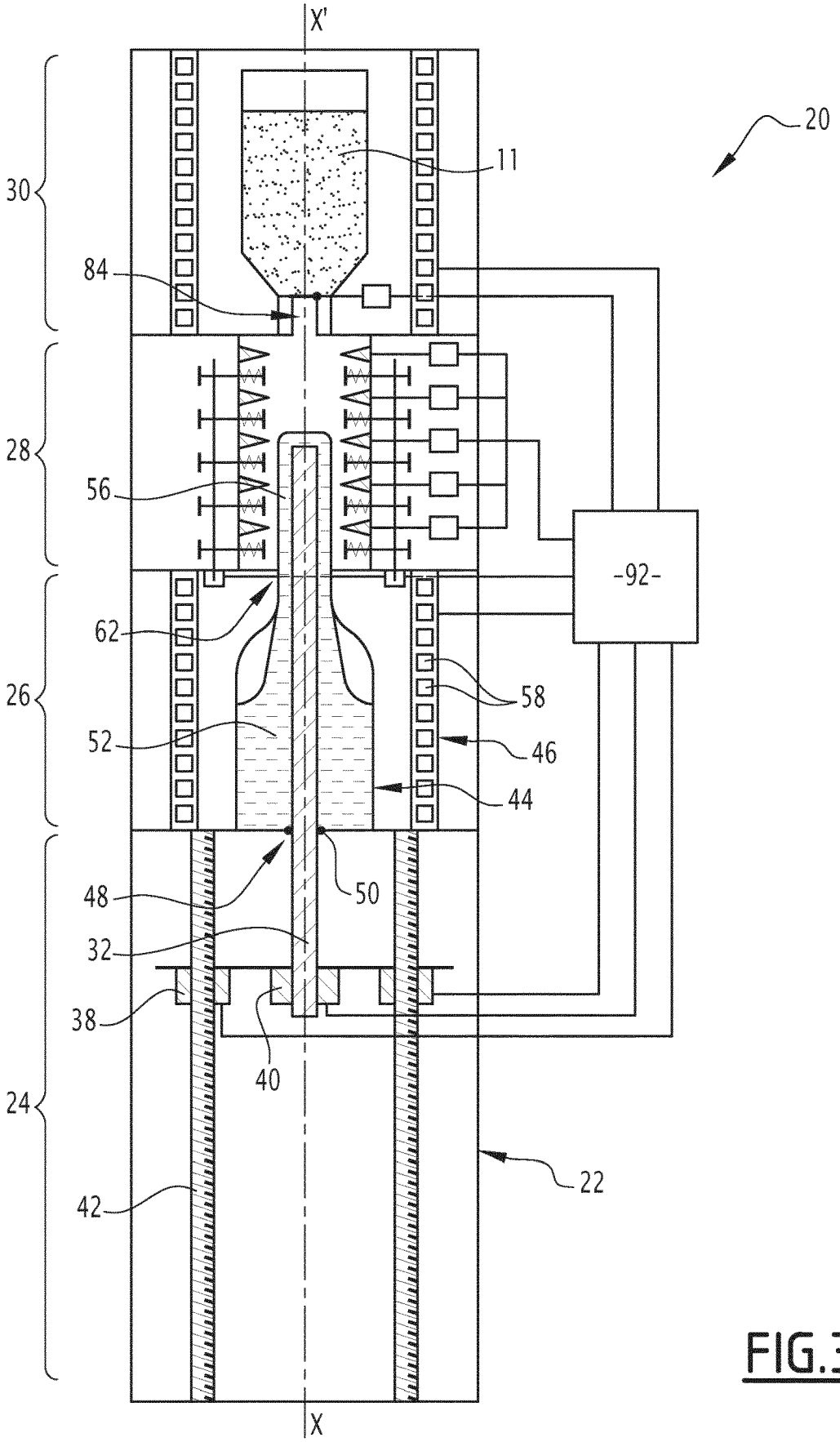

As shown on FIG. 3, the rod 32 is free to move through the first reservoir 44, in the material 52, that is in the viscous state and can adhere to an external surface 54 of the rod 32 to form a continuous peripheral layer 56 driven towards the shaping module 28 by the translation movement of the rod 32.

The first heating device 46 comprises a plurality of infrared diodes 58, capable of emitting infrared radiation towards the first reservoir 44.

Advantageously, the first reservoir 44 comprises walls 60 practically transparent to infrared radiation, such that the infrared radiation is absorbed by the material 52 contained in the first reservoir 44 and raises its temperature.

The first heating device 46 is thus capable of keeping the material 52 contained in the first reservoir 44 in the viscous state, with a temperature of the material 52 kept equal to or above a vitreous transition temperature of the material 52, for example between 110° C. and 250° C. for PE or PET. The vitreous transition temperature is, for example, measured by ISO standard 6721-11:2012.

In the example in which the material 52 is glass, the temperature of the material 52 in the first reservoir 44 is for example between 800° C. and 1200° C., and particularly between 800° C. and 1000° C.

The viscosity of the material at the temperature at which the process is implemented is less than $5\times10^5$ Pa·s and in particular is between $5\times10^2$ Pa·s and $5\times10^5$ Pa·s, as measured by standard ISO 2555.

The first reservoir 44 also has an upper opening 62, opening up into the shaping module 28 and forming an extrusion die capable of shaping an external surface 63 of the layer 56 of material 52 coating the rod 32 as it passes through the upper opening 62, as shown on FIG. 3.

The upper opening 62 has approximately the same section in a plane orthogonal to the X-X' central axis as a required external section of the side wall 12 of the capsules 10.

The shaping module 28 comprises a clamping device 64 of the layer 56 and a cutting device 66 of the layer 56 to form the side walls 12 of the capsules 10.

The clamping device 64 comprises at least one clamp 68 located in the shaping module 28, and at least one actuator 70 of the or each clamp 68.

In the example shown on FIGS. 2 to 6, the clamping device 64 comprises several clamps 68 at a uniform spacing along the X-X' central axis in the shaping module 28.

The actuator 70 of each clamp 68 may for example comprise a spring 71 arranged to force the clamp 68 towards a closed position, and a switching device 72 capable of holding the clamp 68 in an open position and releasing it on order.

In the open position represented on FIG. 3, the clamp 68 is at a distance from the layer 56.

Figure 4:
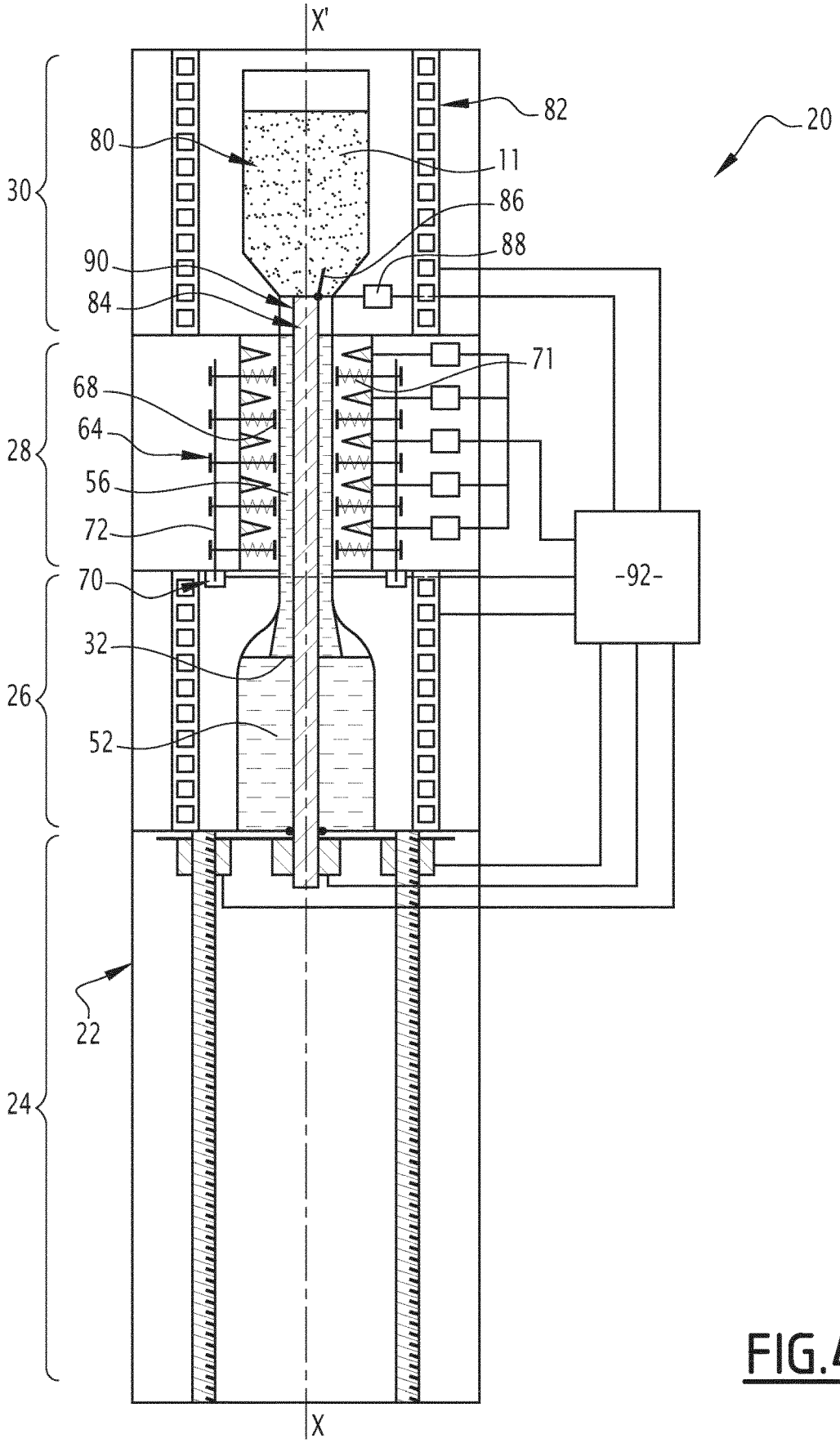

In the closed position represented on FIG. 4, the clamp 68 is in contact with the layer 56 and applies a pressure on it along a direction orthogonal to the X-X' central axis; so as to prevent displacements of the layer 56 along the X-X' central axis.

The clamping device 64 is thus capable of holding the layer 56 in place in the shaping module 28 during withdrawal of the rod 32, exposing an internal slot 74 in the space occupied by the rod 32.

Advantageously, each of the clamps 68 is adapted to shape the layer 56 when it applies a mechanical pressure on it. For example, an internal surface of the clamp 68 has relief such that the layer 56 can be cast to form corresponding relief, such as grooves, or hollow or projecting shapes such as fins or other.

The cutting device 66 comprises at least one cutting element 76 located in the shaping module 28, perpendicular to the X-X' central axis and at least one actuator 78 of the or each cutting element 76.

The or each cutting element 76 may for example be a diaphragm with a cutting inside edge, centered on the X-X' central axis.

In the example represented on FIGS. 2 to 6, the cutting device 66 comprises a plurality of cutting elements 76, at a uniform spacing along the X-X' central axis and alternating with the clamps 68 of the clamping device 64. The distance between two adjacent cutting elements 76 along the X-X' central axis is approximately equal to the length required for the capsules 10.

As a variant (not shown), the cutting device 66 comprises a single cutting element 76 mounted on a support free to move in translation along the X-X' central axis between a plurality of cutting positions at regular intervals along the X-X' central axis.

Figure 6:
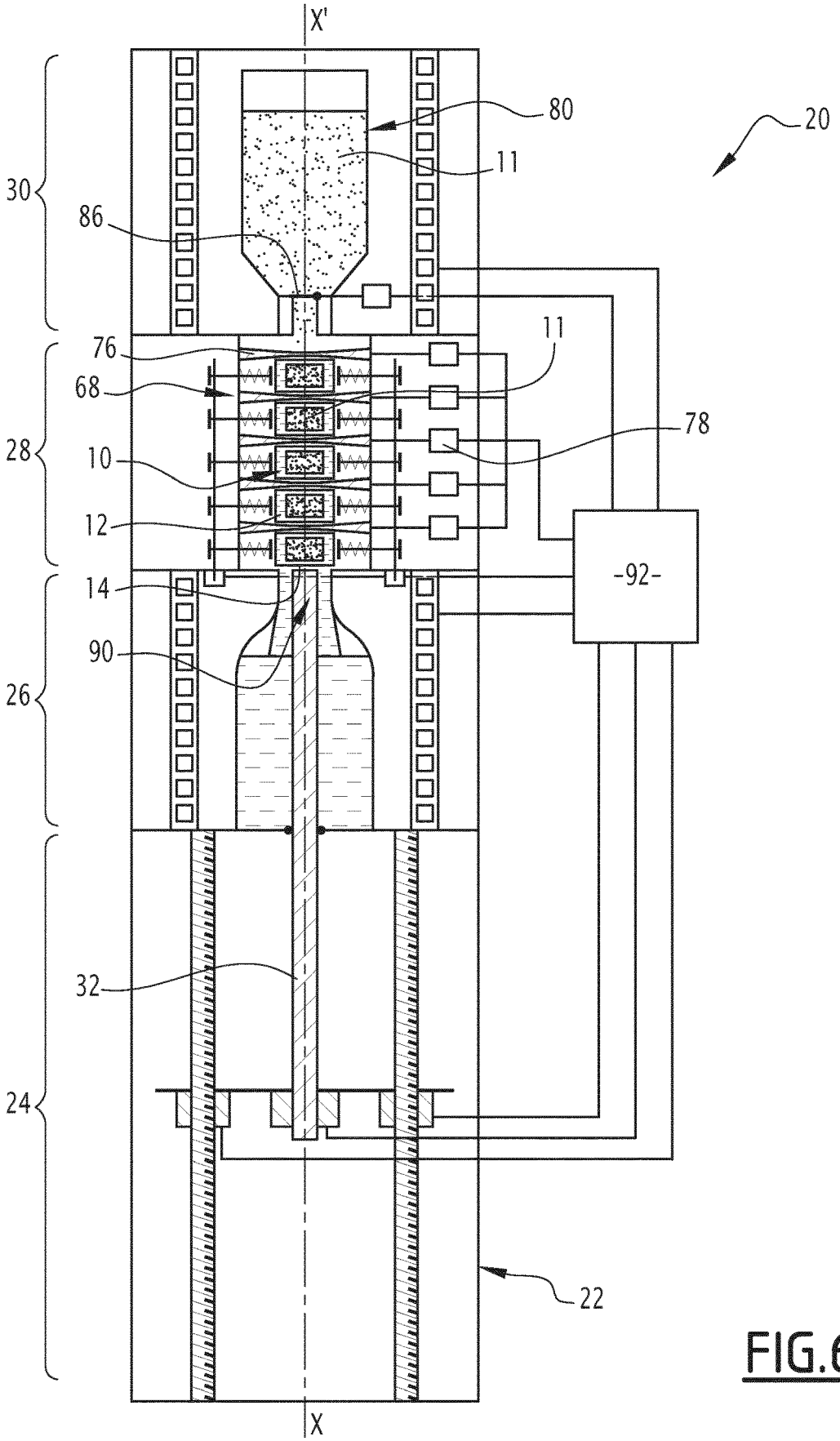

As shown on FIG. 6, each cutting element 76, when it is activated, is capable of cutting the layer 56 into segments forming side walls 12 of capsules 10, deforming the material 52 forming the layer 56.

In the embodiment shown on FIGS. 2 to 6, each cutting element 76 is capable of draping the material 52 forming the layer 56 through the internal slot 74 when cutting the layer 56 into segments to form a thin layer of material 52 closing the internal space of each capsule 10 and forming the seal 14.

As a variant (not shown) the shaping module 28 also comprises a film winding device capable of forming seals 14, placed close to the upper opening 62 of the coating module 26.

The unwinding device is capable of stretching the film around the external surface 63 of the layer 56 of material 52 as it exits through the upper opening 62.

The film can be draped around the side walls 12 of each capsule 10 through cutting elements 76, through the internal slot 74 to form seals 14.

The filling module 30 comprises a second reservoir 80 and a second device 82 heating a content of the second reservoir 80.

The second reservoir 80 is capable of containing the cosmetic product 11 that will fill the internal space of the capsules 10. It has an outlet nozzle 84 opening into the shaping module 28, the nozzle 84 comprising a closing valve 86 of the second reservoir 80 and an actuator 88 of the valve 86.

Figure 5:
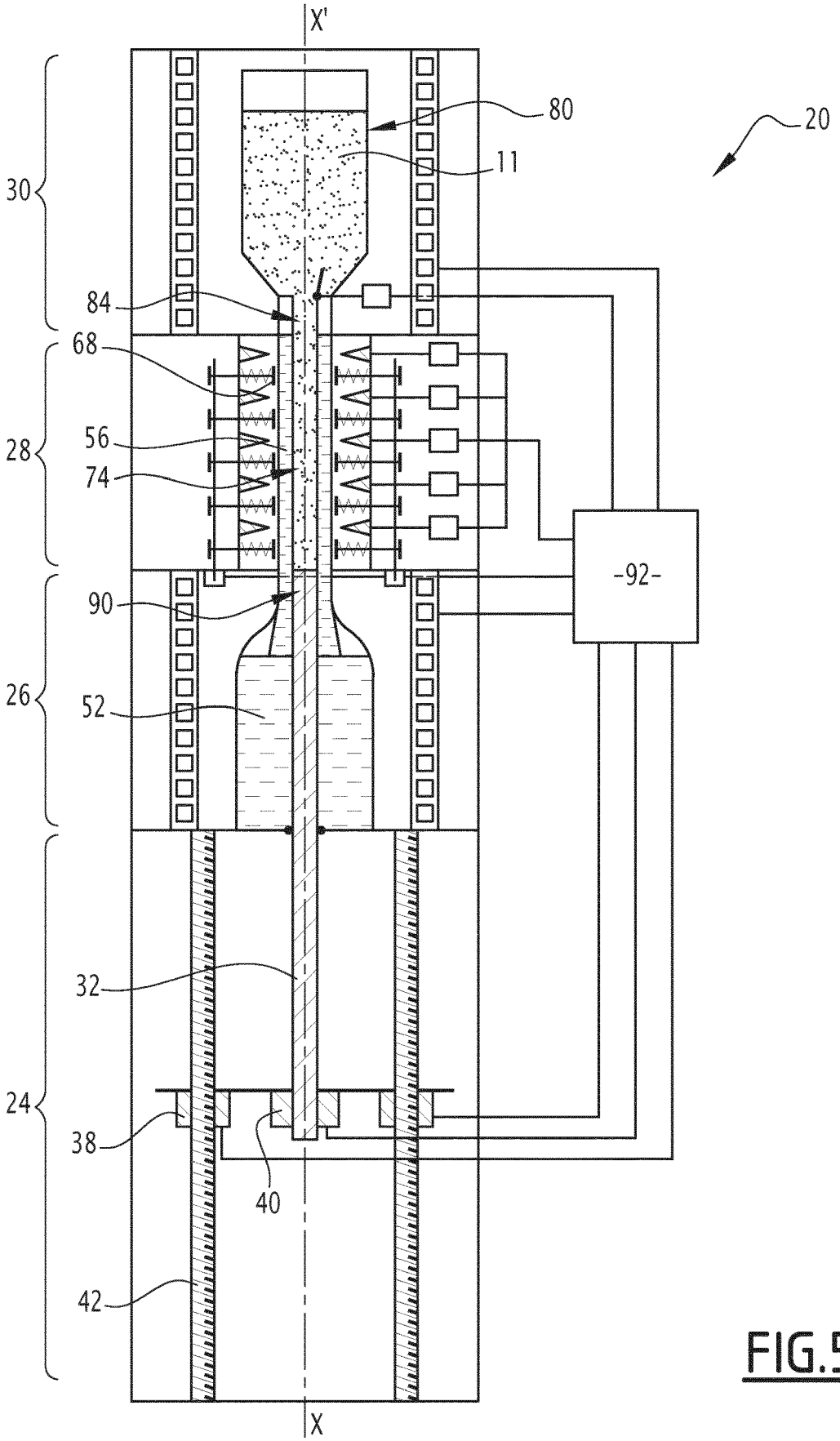

The nozzle 84 has a section in a plane orthogonal to the X-X' central axis practically the same as the section of the rod 32, such that a distal end 90 of the rod 32 can be inserted in the nozzle 84 and close it so as to be almost leak tight at the end of the translation movement of the rod 32, as represented on FIG. 5.

The valve 86 is capable of opening and closing the nozzle 84 on order, under the effect of the actuator 88.

The nozzle 84, when it is open, enables the flow of cosmetic product 11 in the shaping module 28, the cosmetic product 11 flowing in the internal slot 74 of the layer 56 during withdrawal of the rod 32, as shown on FIG. 5.

The second heating device 82 is similar to the first heating device 46. It is capable of heating the cosmetic product 11 to a temperature such that it can flow, the flow temperature depending on the nature of the cosmetic product 11 and its viscosity. In particular, the flow temperature of the cosmetic product 11 is between ambient temperature and 80° C.

Advantageously, the filling module 30 comprises a emptying device for the cosmetic product 11 contained in the second reservoir 80, capable of pressurizing the content of the second reservoir 80, for example making use of compressed air and/or a piston. This improves the outlet of the cosmetic product 11 through the nozzle 84 and its entry into the internal slot 74, and is particularly advantageous for cosmetic products 11 with high viscosity.

Advantageously, the preparation system 20 comprises a control module 92 configured to the control the translation actuator 38 and the rotation actuator 40, the first heating device 46 and the second heating device 82, the actuators 70 of the clamps and the actuators 78 of cutting elements, and the actuator 88 of the valve 86. The control module 92 thus provides automated and central control of the preparation system 20. The control module is preferably housed in a computer (not shown) comprising a memory and a processor capable of executing software modules present in the memory.

A process for manufacturing a plurality of capsules 10 will now be described, making use of the preparation system 20 described above.

The process comprises preliminary steps to fill the first reservoir 44 and the second reservoir 80, with a material 52 that will form the side wall 12 of the capsules 10 and with a cosmetic product 11 that will the capsules 10.

The process also comprises a preliminary step heating the material 52 that will form the side wall 12 at a temperature at which the material 52 is in the viscous state, and if necessary heating the cosmetic product 11 to a temperature at which the cosmetic product 11 flows easily. These temperatures are maintained in the first reservoir 44 and in the second reservoir 80 respectively throughout the above.

The process comprises a displacement step of the rod 32, represented on FIG. 3, both in translation along the X-X' central axis, in the direction of the filling module 30, and in rotation about the X-X' central axis under the action of the translation actuator 38 and the rotation actuator 40.

The rod 32 moves through the actuation module 24, then through the lower opening 48 and the coating module 26. The rod 32 passes through the first reservoir 44 and is coated with a layer of 56 of material 52 in the viscous state.

The rod 32 then passes through the upper opening 62 that performs the role of an extrusion die and forms an external surface 63 of the layer 56 of viscous material 52. The shape conferred on the external surface of the layer 56 of viscous material 52 in particular is cylindrical.

The rod 32 then moves through the shaping module 28, until the distal end 90 of the rod 32 is inserted in the outlet nozzle 84 of the second reservoir 80 that it closes in a sealed manner as shown on FIG. 4. In the shaping module 28, the layer 56 of material 52 that is no longer subject to the action of the first heating device 46, cools and solidifies.

The clamping device 64 is actuated and the clamps 68 come into contact with the external surface 63 of the layer 56 and apply a mechanical stress that holds the layer 56 in place in the shaping module 28, as shown on FIG. 4.

The formed and clamped layer 56 is then continuous around the X-X' axis. Its thickness is more than 1 mm and particularly between 1 mm and 5 mm. The valve 86 closing the second reservoir 80 is then open as shown on FIG. 5, and the rod 32 is withdrawn from the shaping module 28, the rod 32 moving both in translation along the X-X' central axis towards the actuation module 24, and in rotation about the X-X' central axis. The rod 32 is extracted outside the layer 56 of solidified material 52, and exposes an approximately cylindrical internal slot 74 defined by the layer 56.

The cosmetic product 11 enters in the internal slot 74 at the same time that the rod 32 is withdrawn, continuously filling the exposed space. Advantageously, withdrawal of the rod 32 creates a vacuum that draws the cosmetic product 11 into the internal slot 74 and facilitates its flow. Also advantageously, no gas enters the internal slot 74 which limits the risk of contamination of cosmetic product 11 through ambient air.

If the filling module 30 comprises a drain device, pressurization of the cosmetic product 11 in the second reservoir 80 facilitates its outlet through the nozzle 84 and its entry in the slot 74.

Once the rod 32 has been fully withdrawn from the shaping module 28, the cutting device 66 is activated and cutting elements 76 cut the layer 56 into several approximately identical segments forming the side walls 12 of the capsules 10 as shown on FIG. 6.

At the same time as cutting into segments, each cutting element 76 drapes the material 52 of the layer 56 through the internal slot 74 to form two thin layers of material forming the seals 14 closing the internal space of each capsule 10 containing the cosmetic product 11.

The cutting elements 76 are then folded and the capsules 10 are extracted from the shaping module 28.

As a variant (not shown), the entry of the rod 32 supporting the layer 56 in the shaping module 28 causes the unwinding device to stretch a film on the external surface of the layer 56. The film is then draped through the internal slot 74 by the cutting elements 76 during cutting the layer 56 into segments, and forms the seals 14.

The described preparation system 20 and the process for manufacturing a plurality of capsules 10 can produce capsules in an automated manner with a satisfactory yield, for example between fifty and one hundred capsules 10 per minute.

They can easily be adapted to a variety of dimensions and contents for the capsules 10 due to their modular nature. Indeed, it is sufficient to modify the spacing of cutting elements 76 or to replace the extrusion die or the rod 32 for one with a different diameter to modify each of the dimensions of the capsules.

Finally, it is easy to adapt the preparation system 20 to the production of capsules 10 of different materials or containing different cosmetic products 11 simply by changing the content of the first reservoir 44 and/or the second reservoir 80, and at the same time modifying the set temperatures of the first heating device 46 and/or of the second heating device 82 respectively.

The invention claimed is:

1. A process for manufacturing a plurality of capsules, each capsule comprising a side wall and two seals defining an internal space containing a cosmetic product, the process including:

displacement of a support through a first reservoir containing a viscous material designed to form the side wall, and coating of the support with a layer of viscous material;

displacement of the support through a shaper and solidification of the layer of viscous material;

withdrawal of the support outside the shaper, freeing an internal slot defined by the layer of solidified material;

entry of at least one cosmetic product from a second reservoir into the internal slot; and cutting of the layer of solidified material using a cutting device to form the side wall of at least one capsule, and sealing of the internal space of the at least one capsule containing the at least one cosmetic product by seals.

2. The process according to claim 1, wherein the viscous material is kept in a viscous state in the first reservoir by heating, and is solidified in the shaper by cooling.

3. The process according to claim 1, wherein during the withdrawal of the support outside the shaper, the at least one cosmetic product fills the internal slot simultaneously as the support is withdrawn, the at least one cosmetic product continuously filling in a released space.

4. The process according to claim 1, wherein the displacement of the support through the shaper comprises passage of the layer of viscous material through an extrusion die shaping an external surface of the layer of viscous material.

5. The process according to claim 1, wherein the displacement of the support through the shaper comprises drawing a film in contact with an outside surface of the layer of viscous material, the film being capable of forming seals during the cutting of the layer of solidified material.

6. The process according to claim 1, wherein the cutting of the layer of solidified material includes a wrapping of the solidified material forming the layer through the internal slot to form seals, the seals being integral with the side wall.

7. The process according to claim 1, wherein the displacement of the support through the shaper comprises creating a watertight contact between a distal end of the layer of solidified material and an outlet nozzle of the second reservoir, the withdrawal of the support drawing the at least one cosmetic product outside the second reservoir.

8. The process according to claim 1, also comprising:

blocking of the layer of solidified material in the shaper and opening of an outlet nozzle of the second reservoir leading into the shaper and facing the support.

9. The process according to claim 1, wherein the entry of the at least one cosmetic product into the internal slot comprises pressurizing the at least one cosmetic product contained in the second reservoir, the pressurizing facilitating entry of the at least one cosmetic product into the internal slot.

10. The process according to claim 2, wherein during the withdrawal of the support outside the shaper, the at least one cosmetic product fills the internal slot simultaneously as the support is withdrawn, the at least one cosmetic product continuously filling in a released space.

11. The process according to claim 2, wherein the displacement of the support through the shaper comprises passage of the layer of viscous material through an extrusion die shaping an external surface of the layer of viscous material.

12. The process according to claim 3, wherein the displacement of the support through the shaper comprises passage of the layer of viscous material through an extrusion die shaping an external surface of the layer of viscous material.

13. The process according to claim 2, wherein the displacement of the support through the shaper comprises drawing a film in contact with an outside surface of the layer of viscous material, the film being capable of forming seals during the cutting of the layer of solidified material.

14. The process according to claim 3, wherein the displacement of the support through the shaper comprises drawing a film in contact with an outside surface of the layer of viscous material, the film being capable of forming seals during the cutting of the layer of solidified material.

15. The process according to claim 4, wherein the displacement of the support through the shaper comprises drawing a film in contact with an outside surface of the layer of viscous material, the film being capable of forming seals during the cutting of the layer of solidified material.

16. A system for preparing capsules, each capsule comprising a side wall and two seals defining an internal space containing a cosmetic product, the system comprising:

a fixed frame extending along a central axis;

a support translatable along the central axis relative to the frame;

an actuation module for actuating the support in translation;

a first reservoir designed to contain a viscous material designed to form the side wall of the capsules;

a shaper for shaping the capsules, the shaper comprising a cutting device;

a second reservoir capable of containing at least one cosmetic product, the second reservoir comprising an outlet nozzle, the support being movable along a back and forth movement successively through the first reservoir and the shaper to form a side wall with an internal slot, the outlet nozzle being arranged to face the internal slot to fill the internal slot with cosmetic product.

17. The system according to claim 16, wherein the support is a cylindrical rod extending parallel to the central axis, the actuation module being capable of displacing the support in translation along the central axis and in rotation about the central axis.

18. The system according to claim 16, wherein the central axis extends vertically relative to gravity.

19. The system (20) according to claim 16, wherein the cutting device comprises a plurality of cutting elements arranged perpendicular to the central axis and regularly spaced in the shaper along the central axis.

20. The system according to claim 16, wherein the actuation module, the first reservoir, the shaper, and the second reservoir are arranged in line along the central axis, the outlet nozzle of the second reservoir opening up into the shaper.

* * * * *